US008082888B2

(12) United States Patent
Lannes et al.

(10) Patent No.: US 8,082,888 B2
(45) Date of Patent: Dec. 27, 2011

(54) THERMAL SWITCH FOR ENERGY SUSTAINING WATER HEATER

(75) Inventors: Eric M. Lannes, Caledonia, MI (US); Garrett Doss, Wyoming, MI (US)

(73) Assignee: Bradford White Corporation, Ambler, PA (US)

( * ) Notice: Subject to any disclaimer, the term of this patent is extended or adjusted under 35 U.S.C. 154(b) by 627 days.

(21) Appl. No.: 12/207,151

(22) Filed: Sep. 9, 2008

(65) Prior Publication Data

US 2010/0058997 A1 Mar. 11, 2010

(51) Int. Cl.
*F22B 5/04* (2006.01)

(52) U.S. Cl. ..... 122/14.2; 122/4 A; 431/80

(58) Field of Classification Search ..... 126/285 B, 126/286, 344; 431/80; 122/155.1, 155.2, 122/14.2, 14.21, 14.1, 4 A
See application file for complete search history.

(56) References Cited

U.S. PATENT DOCUMENTS

| | | | | |
|---|---|---|---|---|
| 4,778,378 | A * | 10/1988 | Dolnick et al. | 431/79 |
| 5,393,221 | A * | 2/1995 | McNally | 122/14.1 |
| 5,954,265 | A * | 9/1999 | Hall et al. | 236/94 |
| 6,749,124 | B2 * | 6/2004 | Weiss | 236/1 G |
| 6,915,799 | B2 * | 7/2005 | Weiss | 126/536 |
| 2005/0066958 | A1 * | 3/2005 | Guzorek | 126/285 R |
| 2009/0191493 | A1 * | 7/2009 | Guzorek | 431/12 |
| 2009/0191495 | A1 * | 7/2009 | Guzorek | 431/20 |
| 2009/0277399 | A1 * | 11/2009 | Guzorek et al. | 122/14.22 |
| 2010/0012048 | A1 * | 1/2010 | Whitford et al. | 122/14.21 |

* cited by examiner

*Primary Examiner* — Gregory A Wilson
(74) *Attorney, Agent, or Firm* — RatnerPrestia

(57) ABSTRACT

A water heater is provided that includes a tank for storing water and a combustion chamber in thermal communication with the tank for heating the water. The combustion chamber contains a pilot burner and at least one main burner. The water heater also includes a flue containing a flue damper to control the passage of exhaust gases from said combustion chamber. The water heater further includes an electrical control circuit connected to said flue damper. The electrical control circuit includes a thermal switch positioned proximal to the main burner The thermal switch is configured to prevent the flue damper from closing while the main burner is firing.

14 Claims, 6 Drawing Sheets

THERMAL SWITCH FOR ENERGY SUSTAINING WATER HEATER

FIELD OF THE INVENTION

The present invention relates generally to a water heater configured for preventing a flue damper of the water heater from closing while a burner is firing.

BACKGROUND OF THE INVENTION

Gas fired water heaters optionally include a damper that controls the passage of exhaust gases from a combustion chamber. An example of such a water heater is described in U.S. Pat. No. 6,684,821 to Lannes et al.

The Lannes patent discloses an improved water heater in which energy can be sustained within the water heater to allow for the reliable operation of the water heater even in the event of a power failure. When the temperature of water in the tank of the water heater reaches the set point of a thermostat, the thermostat switches, opening the circuit between a wire supplying power to the thermostat and a wire leading to a damper, and closing the circuit between the wire supplying power to the thermostat and the wire connected to a pressure switch. When the gas is no longer flowing through a manifold, the pressure switch closes, completing a circuit between the thermostat and the wire leading to the damper. The completion of this circuit supplies power to the damper motor so that a damper vane moves to the closed position.

Despite improvements in gas-fired water heaters such as those disclosed in the Lannes patent, there remains a need for continued improvements.

SUMMARY OF THE INVENTION

The present invention provides a water heater comprising a tank for storing water and a combustion chamber in thermal communication with said tank for heating said water. The combustion chamber contains a pilot burner and at least one main burner. The water heater also comprises a flue containing a flue damper to control the passage of exhaust gases from the combustion chamber and an electrical control circuit connected to the flue damper. The electrical control circuit includes a thermal switch positioned proximal to the main burner. The thermal switch is configured to prevent the flue damper from closing while the main burner is firing.

The present invention further provides a method of manufacturing a water heater. The method comprises mounting a combustion chamber, including at least one main burner, in thermal communication with a tank for heating water in the tank. The method also comprises coupling a flue and a flue damper to the combustion chamber for controlling passage of exhaust gases from the combustion chamber. The method further comprises positioning a thermal switch proximal to the main burner for detecting a temperature proximal to the main burner and connecting the flue damper electrically with the thermal switch.

The present invention further provides a method of controlling a flue damper in a water heater. The method comprises connecting the flue damper to a thermal switch positioned proximal to a burner of the water heater and determining whether the burner is firing using the thermal switch. The method further comprises controlling the flue damper based on the determination of whether the at least one main burner is firing.

BRIEF DESCRIPTION OF THE DRAWINGS

The invention is best understood from the following detailed description when read in connection with the accompanying drawings. Included in the drawings are the following figures.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

The invention is best understood from the following detailed description when read in connection with the accompanying drawing figures, which shows exemplary embodiments of the invention selected for illustrative purposes. The invention will be illustrated with reference to the figures. Such figures are intended to be illustrative rather than limiting and are included herewith to facilitate the explanation of the present invention.

Figure 1:
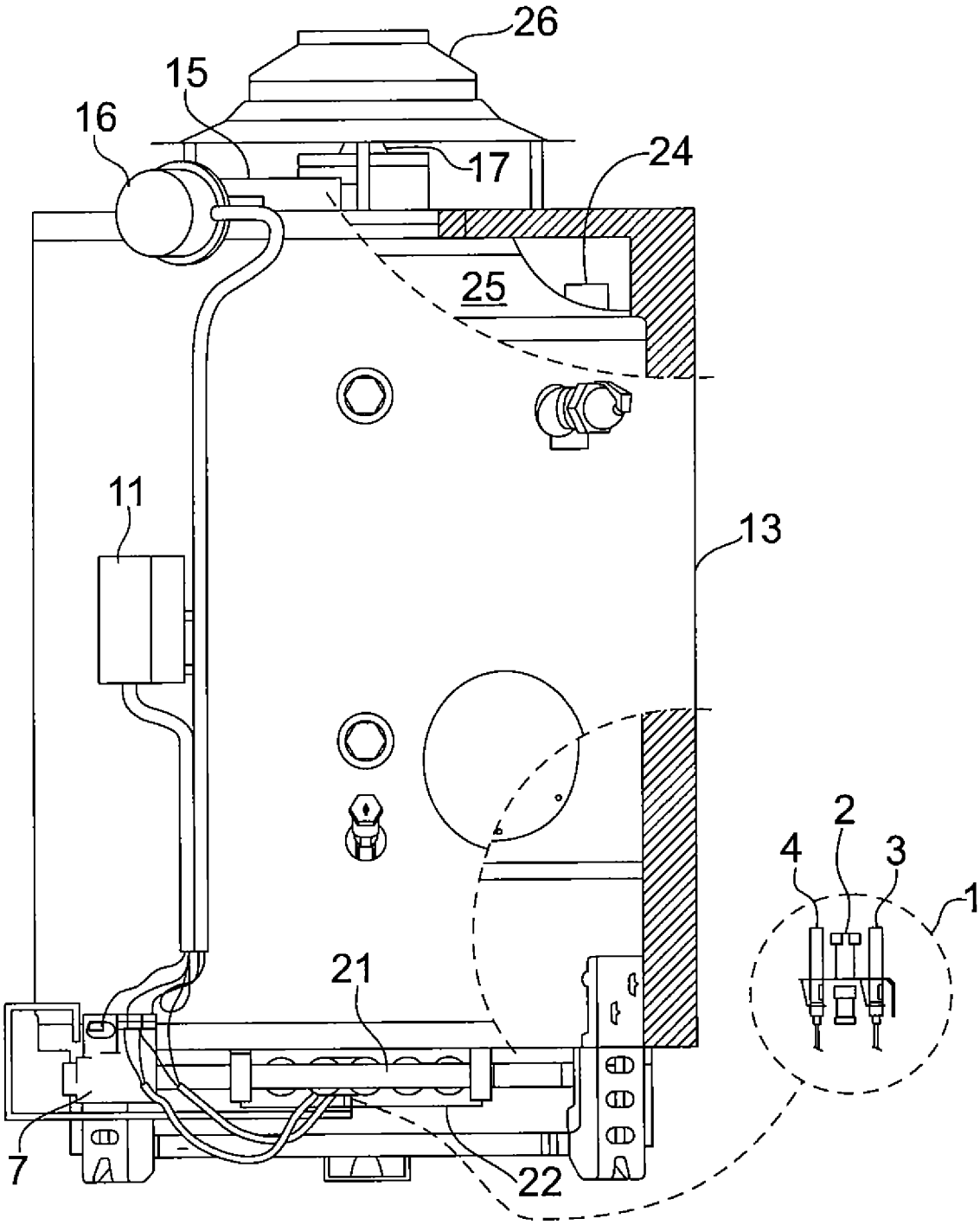
FIG. 1 is an elevation and partial cross-section illustrating a gas water heater according to an exemplary embodiment of the present invention.
Figure 2:
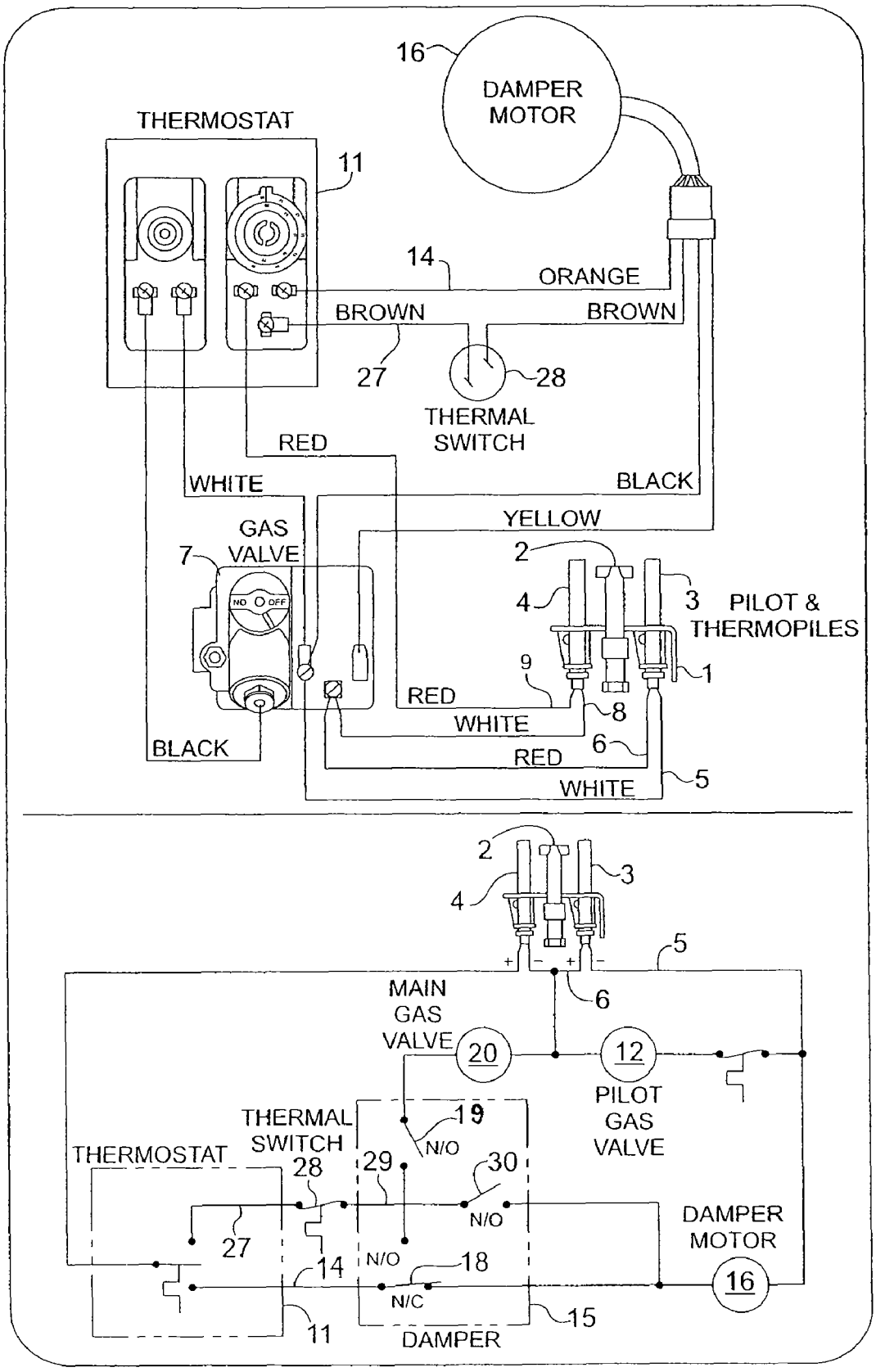
FIG. 2 is a schematic illustrating an electrical connection according to an exemplary embodiment of the present invention.

An exemplary embodiment of the invention is illustrated in FIGS. 1 and 2. Referring to FIGS. 1 and 2, the pilot and thermopile assembly 1 of the exemplary embodiment of the present invention consists of a pilot burner 2 and two thermo-voltaic devices 3 and 4 located proximally thereto. Pilot burner 2 is lit in a conventional manner when the water heater is brought into operation. The pilot flame from pilot burner 2, which may or may not be in contact with thermo-voltaic devices 3 and 4, provides heat energy to thermo-voltaic devices 3 and 4, which thereby create electrical energy. Thermo-voltaic devices 3 and 4 preferably comprise thermopiles, but are not necessarily limited thereto. The operation of thermopiles is well known to those of ordinary skill in the art and will not be further elaborated upon here except to note the voltage produced by thermo-voltaic devices 3 and 4 is preferably in the milli-volt (mV) range.

While two thermopiles are shown in the preferred embodiment, those of ordinary skill in the art will appreciate that more or less thermopiles may be used depending on the voltage and current required and the performance characteristics of thermopiles used. However, by using two thermopiles in the manner illustrated, the output from a single pilot burner is maximized while keeping the overall size of the pilot assembly to a minimum.

Thermo-voltaic devices 3 and 4 are preferably, but not necessarily, wired in series. Lead wires 5 and 6 for thermo-voltaic device 3 are connected to the gas valve 7, and the lead wire 8 for the thermo-voltaic device 4 is connected to the gas valve 7, with wire 9 for the device 4 being connected to the thermostat 11 to provide power thereto, as shown. Thermo-voltaic device 3 supplies the power needed to hold open the pilot valve 12 located in the gas valve 7. The pilot 2 remains lit the entire time that the water heater is in operation.

Thermostat 11 is preferably located in an opening on tank 13 to measure the temperature of the water in tank 13. The type of thermostat used for thermostat 11 is not particularly limited and may comprise one of a number of conventional thermostats, such as bimetallic or thermocouple based thermostats, the operation of which is well known in the art. When thermostat 11 detects the need to heat the water, it closes the circuit between wire 9 supplying power to the thermostat 11 from thermo-voltaic devices 3 and 4 and wire 14 leading from thermostat 11 to damper 15. As a result of this completed circuit, power is delivered to damper motor 16, causing damper vane 17 to move into the full open vertical position.

When damper vane 17 reaches the full open vertical position, switches 18 and 19 are actuated. Switch 18 opens the circuit providing power to the motor and acts in series with switch 19 to complete a circuit providing power to main gas valve 20. Main gas valve 20 then opens supplying gas through manifold 21 to the main burners 22 in a conventional manner, and main burners 22 are ignited by the pilot flame. The gas is burned in the combustion chamber 23. The products of combustion rise through the flue tubes 24, collector 25, and opened flue damper 15. The combustion products then exit the water heater through draft diverter 26 into the installation's venting system (not shown).

When the temperature of the water in the tank reaches the set point of thermostat 11, thermostat 11 switches, opening the circuit between wire 9 supplying power to the thermostat and wire 14 leading to switch 18 in the flue damper 15, and closing the circuit between wire 9 supplying power to the thermostat 11 and wire 27 connected to a thermal switch 28. When power is interrupted in the circuit leading to switch 18 in the flue damper 15, the power to main gas valve 20 is interrupted.

An exemplary thermal switch may be Model No. 36TXVG11 of Thermodisc, Inc., of 1320 South Main Street, Mansfield, Ohio 44907. Other switches are optionally used.

Figure 3:
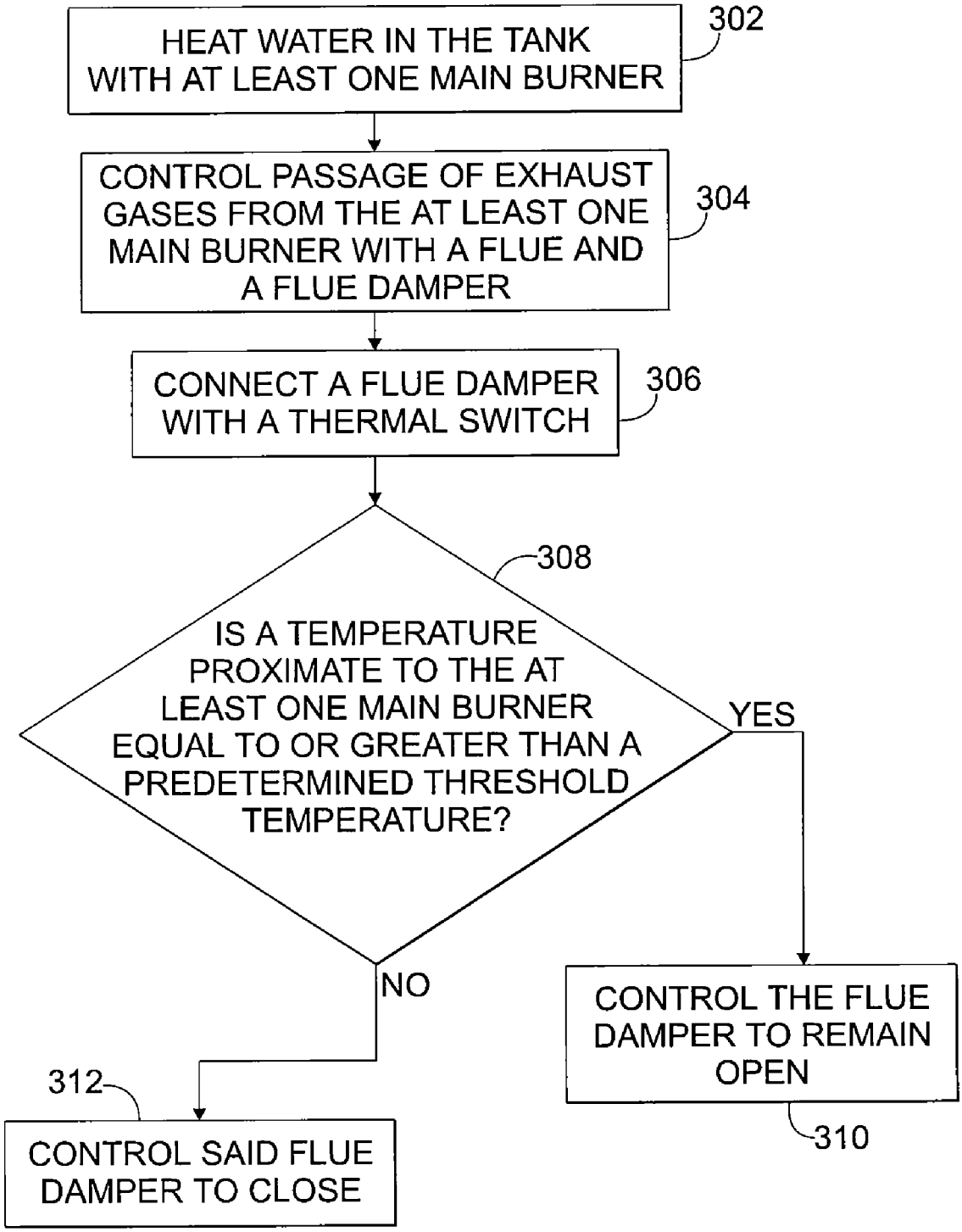
FIG. 3 is a flowchart illustrating an exemplary method for controlling a flue damper in a water heater.

FIG. 3 illustrates a method of controlling a flue damper in a water heater according to an exemplary embodiment of the invention. As shown at step 302, water is heated in the tank 13 with at least one main burner 22. As shown at step 304, the passage of exhaust gases from the at least one main burner 22 is controlled with flue 24 and flue damper 15.

Thermal switch 28 is coupled to flue damper 15, as shown at step 306. Thermal switch 28 determines whether the at least one main burner 22 is firing after the temperature of the water in the tank reaches the set point of thermostat 11. It is contemplated that thermal switch 28 may determine whether the at least one main burner 22 is firing by sensing whether a temperature proximate to the main burner is equal to or greater than a predetermined threshold temperature as shown at step 308.

If the at least one main burner 22 is determined to be firing, flue damper 15 is controlled to remain open, as shown at step 310. For example, if main gas valve 20 were to remain open after the temperature of the water in the tank reaches the set point of thermostat 11, thermal switch 28 would continue to sense heat from the main burners 22 and remain open. If thermal switch 28 remains open, the circuit is not completed, power is not supplied to damper motor 16, and damper vane 17 remains in the open position.

Alternatively, if the at least one main burner 22 is determined to not be firing, flue damper 15 is controlled to close, as shown at step 312. When thermal switch 28 no longer senses heat from the main burner or burners 22, thermal switch 28 closes, completing a circuit between thermostat 11 and wire 29 leading to damper 15. The completion of this circuit supplies power to damper motor 16 so that damper vane 17 moves to the closed position. When damper vane 17 moves to the closed position, switch 30 opens, interrupting power to damper motor 16.

If the damper vane 17 is caused to move to the closed position, the damper vane 17 preferably remains closed while the water heater is in standby, reducing energy loss from the water heater. Pilot burner 2 continues to burn so that the energy is available for another cycle when the water in the tank 13 becomes cold enough to again activate the thermostat 11, without the need for an external source of power to operate damper motor 16.

Figure 4:
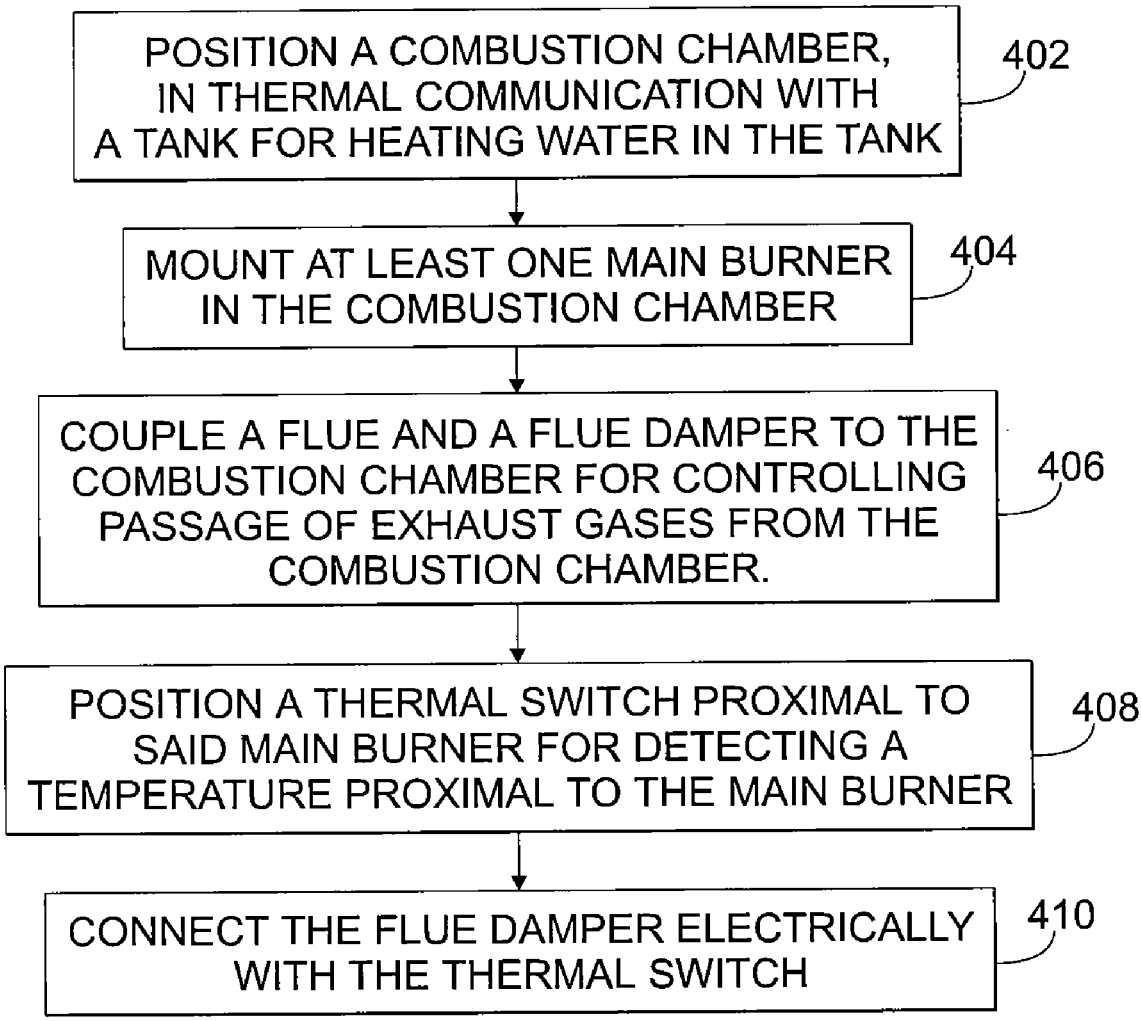
FIG. 4 is a flowchart illustrating an exemplary method for manufacturing a water heater.
Figure 5:
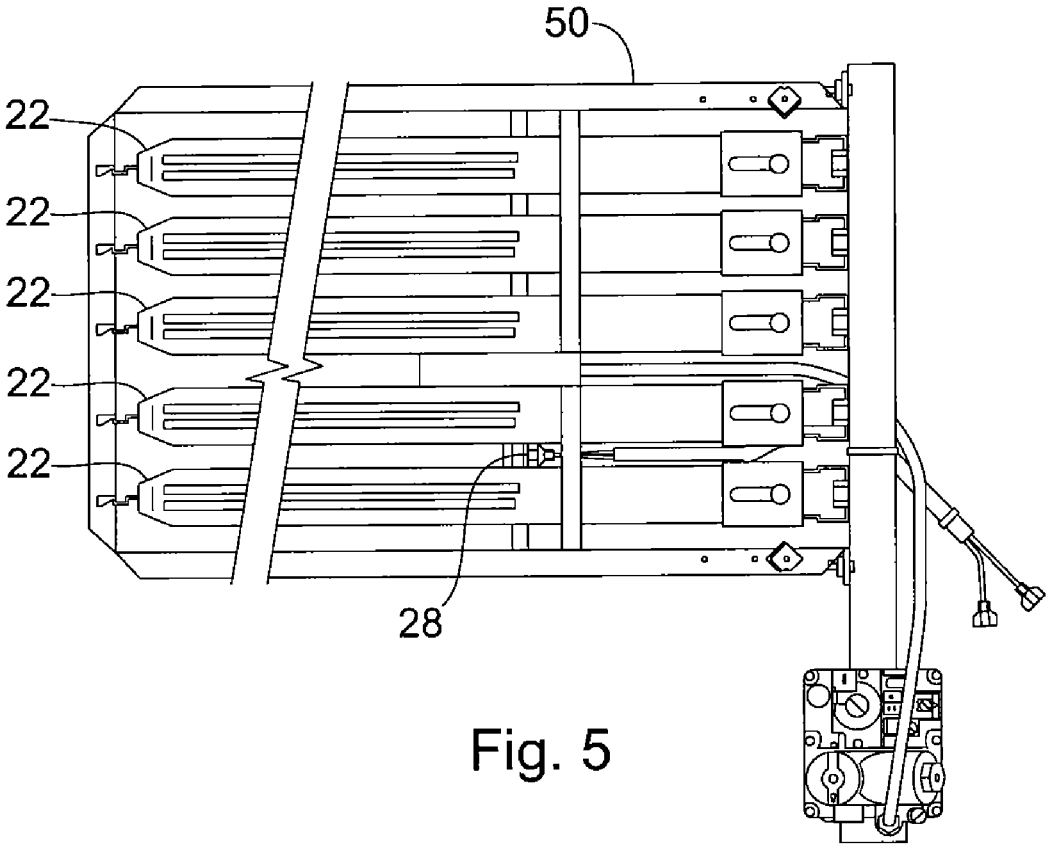
FIG. 5 is a top view of an exemplary burner rack according to an exemplary embodiment of the invention.

FIG. 4 is a flowchart illustrating an exemplary method for manufacturing a water heater. As shown at step 402, a combustion chamber 23 may be positioned in thermal communication with a tank 13 for heating water in the tank 13. As shown at step 404, at least one main burner 22 may be mounted in the combustion chamber 23. The exemplary embodiment in FIG. 5 shows five main burners. It is contemplated, however, that exemplary combustion chambers may include different numbers of burners, including one burner.

As shown at step 406, a flue 24 and a flue damper 15 may be coupled to the combustion chamber 23 for controlling passage of exhaust gases from the combustion chamber 23. As shown at step 408, a thermal switch 28 may be positioned proximal to the main burner 22 for detecting a temperature proximal to the main burner 22.

Figure 6:
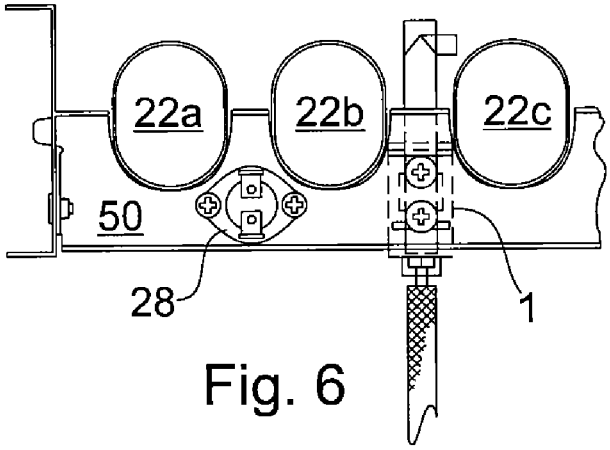
FIG. 6 is a cross-sectional view of the exemplary burner rack shown in FIG. 5.

According to an exemplary embodiment of the invention, the water heater may include a burner rack 50. The burner rack 50 may be coupled to the combustion chamber 23. FIG. 5 is a top view of an exemplary burner rack 50 according to an embodiment of the invention. As shown in FIG. 5, the burner rack 50 may include a plurality of burners 22. The thermal switch may be mounted to the burner rack 50. As shown in FIG. 6, the thermal switch 28 may be mounted to the burner rack 50 at a location between burners 22*a* and 22*b*. The thermopile assembly 1 may also be mounted to the burner rack 50, optionally between burners 22*b* and 22*c*, as shown in FIG. 6. It is contemplated that the thermal switch 28 may be mounted to a burner 22. It is also contemplated that the thermal switch 28 may be mounted to a plurality of burners 22. It is further contemplated that a plurality of thermal switches may be used for sensing a temperature proximal to the burners 22.

Figure 7A:
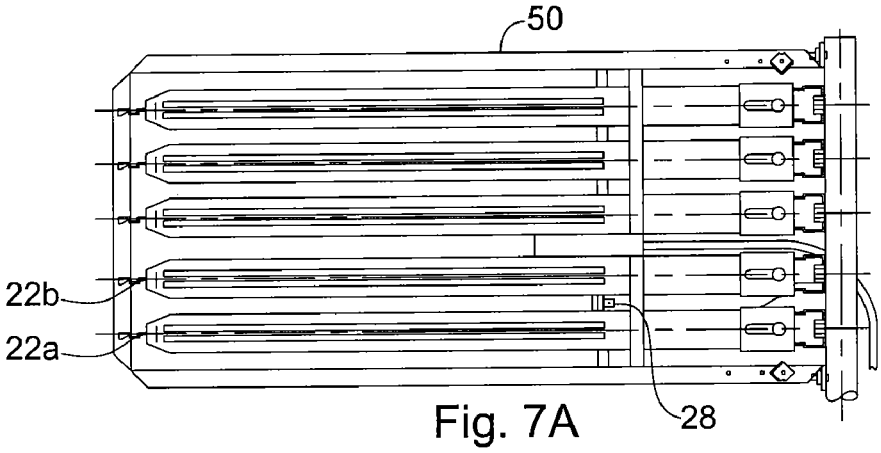
FIGS. 7A through 7C are perspective views of an exemplary burner rack according to another exemplary embodiment of the invention.
Figure 7B:
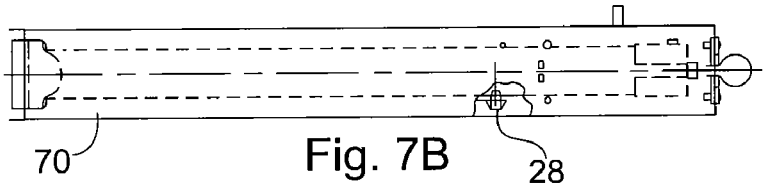
Figure 7C:
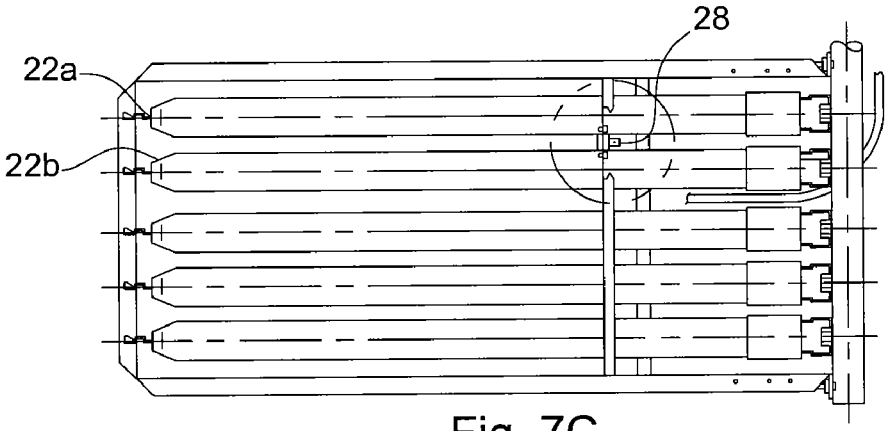
Figure 7D:
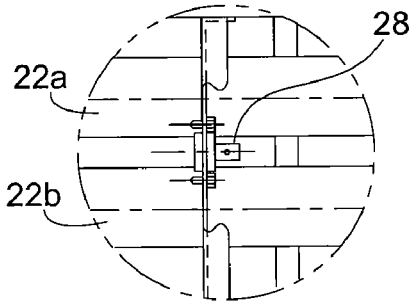
FIG. 7D is an enlarged view of a portion of an exemplary igniter bracket shown in FIG. 7C.

FIGS. 7A-7C are perspective views of an exemplary burner rack according to an embodiment of the invention. FIGS. 7A-7C show a top view, side view and bottom view, respectively, of an exemplary burner rack according to an embodiment of the invention. FIG. 7D is an enlarged view of a portion of the exemplary burner rack shown in FIG. 7C. As shown in FIGS. 7A-7C, the thermal switch 28 may be mounted to the burner rack 50 proximal to burners 22*a* and 22*b*.

Returning to FIG. 4, at step 410, the flue damper 15 (via damper motor 16) may be connected electrically with the thermal switch 28. As shown at FIG. 2, thermal switch 28 is electrically connected to both the thermostat 11 via wire 27 and the damper motor 16 via wire 29 and switch 30. As described above, when the temperature of the water in the tank reaches the set point of thermostat 11, thermostat 11 switches, opening the circuit between wire 9 supplying power to the thermostat and wire 14 leading to switch 18 in the flue damper 15, and closing the circuit between wire 9 supplying power to the thermostat 11 and wire 27 connected to thermal switch 28.

As discussed above, in connection with the exemplary embodiment, the present invention optionally generates power from the use of thermopiles positioned in the pilot flame. The pilot flame is also controlled so it can maximize the thermopile output voltage and prevent the stored water from increasing in temperature to an unsafe level. In the preferred embodiment of the present invention, this is preferably accomplished through the use of a specially sized orifice that limits the flow rate to pilot burner 2. The use of the sized orifice to limit flow rate, coupled with the use of an integral damper upstream of the draft hood, provides a controlled balance of the water temperature and sufficient energy for the gas valve to operate.

The pilot orifice is preferably sized so that the amount of energy generated is capable of operating the damper, but small enough to allow the use of a flue damper on the water heater. Keeping the pilot input at a minimum allows the relief area for the flue damper on the water heater to be as small as possible.

The relief area is required to prevent build up of tank temperature when the water heater is in the standby mode. The proper amount of relief area results in minimal standby loss while preventing water temperatures in the water heater tank from exceeding an acceptable level. Keeping the relief area to a minimum is a significant factor in the effectiveness of the damper in reducing standby loss.

Another function of the relief area is to reduce the amount of torque required to turn the damper vane. When the relief area consists of an air gap or softer materials, the resistance from having the damper vane rub against the outer ring of the damper is eliminated or at least substantially reduced. When the amount of torque required to turn the damper is reduced, the damper requires less energy to turn, which allows the pilot input to be kept at a minimum since less energy must be generated by the thermopiles.

It is also preferred to put redundancy into the safety circuit with a control system that can only use the energy produced by the pilot for operation. By installing a thermal switch on the manifold proximal the burner of the water heater, some redundancy may be added to the safety circuit without increasing the energy needed to operate the control system. The thermal switch is a normally closed switch that opens when heat is sensed from the main burner or burners 22. When the thermostat is satisfied, it de-energizes the gas valve, causing it to close and switch the energy circuit that closes the damper. If the gas valve remains open, however, the temperature switch will not allow this circuit to be completed while the main burners are still firing. For example, the temperature switch will not allow this circuit to be completed while a temperature proximate to the main burner is equal to or greater than a predetermined threshold temperature. In this way, the temperature switch can prevent the damper from closing while the main burners are still firing.

The illustrated embodiments of the present invention optionally use the power generation from the standing pilot to provide sufficient energy to operate the damper to substantially reduce the heat loss from the storage tank when main burners 22 are not operating, while also providing sufficient power to operate a gas valve for providing gas to the main burner(s). The stored water is thereby prevented from reaching undesirable temperatures during the no-burner operating times.

Because of the use of a low voltage thermopile, the safety circuits can be installed in series with the thermopile system to insure the water heater operates when it is called upon to operate, and the damper opens before the main burner(s) operate to prevent heat spillage from the combustion chamber. The damper is opened and remains open during main burner(s) operation, and is closed to reduce the heat loss during no-burner operating times without any external power.

While in the standby mode, the pilot burns gas at a rate that is sufficient to sustain the energy required to operate the damper and gas valve. When the thermostat calls for heat, the damper opens up and allows the gas valve to open after the damper is proved to be opened. The gas flows to the main burner(s) and the combustion products flow through the flue tubes heating the water. The combustion gases exit through the flue collector and damper into the draft diverter, which is connected to the vent system. When the thermostat is satisfied the burners are shut off and the damper closes once it is proven that the gas valve has closed. The water heater continues to operate at the sustained energy level until the next call for operation by the thermostat. While operating at the sustained energy level the temperature of the water in the tank does not go beyond acceptable levels.

Although this invention has been described with reference to particular embodiments, it will be appreciated that many variations may be resorted to without departing from the spirit and scope of this invention. For example, the hot water tank may have single flue tube, with the damper sitting on the flue tube; a collector for the flue products would not be necessary. In addition, there could be a single burner, instead of the multiple main burners described herein. The orifice that restricts airflow at the combustion air inlet to the water heater may also be used instead of a flue damper.

What is claimed:

1. A water heater comprising:

a tank for storing water;

a combustion chamber in thermal communication with said tank for heating said water, said combustion chamber containing a pilot burner and at least one main burner;

a flue with a flue damper to control the passage of exhaust gases from said combustion chamber;

an electrical control circuit connected to said flue damper and including a thermal switch positioned proximal to said main burner, said thermal switch being configured to prevent said flue damper from closing while said main burner is firing, wherein the thermal switch is configured to sense whether a temperature proximate to the main burner is equal to or greater than a predetermined threshold temperature.

2. A water heater according to claim 1, wherein the thermal switch is configured to prevent said flue damper from closing if a temperature proximate to the main burner is equal to or greater than a predetermined threshold temperature.

3. A water heater according to claim 1, further comprising a burner rack coupled to the combustion chamber, the thermal switch being mounted to the burner rack.

4. A water heater according to claim 1, wherein the combustion chamber includes a plurality of burners and the thermal switch is mounted proximal to at least one of the plurality of burners.

5. A water heater according to claim 1, further comprising a thermopile assembly, the thermopile assembly including the pilot burner and at least one thermo-voltaic device configured for providing electrical energy to the electrical control circuit.

6. A water heater according to claim 5, wherein the thermopile assembly is coupled to the combustion chamber.

7. A method of manufacturing a water heater, the method comprising:

mounting a combustion chamber, including at least one main burner, in thermal communication with a tank for heating water in the tank;

coupling a flue and a flue damper to the combustion chamber for controlling passage of exhaust gases from the combustion chamber;

positioning a thermal switch proximal to the main burner for detecting a temperature proximal to the main burner, wherein the thermal switch is configured to sense whether a temperature proximate to the main burner is equal to or greater than a predetermined threshold temperature; and connecting the flue damper electrically with the thermal switch.

8. A method of manufacturing a water heater according to claim 7, further including:

coupling a burner rack to the combustion chamber; and mounting the thermal switch to the burner rack.

9. A method of manufacturing a water heater according to claim 7, further including the steps of:

positioning a plurality of burners in thermal communication with a tank for heating water in the tank; and mounting the thermal switch proximal to at least one of the plurality of burners.

10. A method of manufacturing a water heater according to claim 7, further including the steps of:

coupling a thermostat to the water heater; and connecting the thermostat to the electrical control circuit.

11. A method of controlling a flue damper in a water heater, the method comprising:

connecting the flue damper to a thermal switch positioned proximal to a main burner of the water heater;

determining whether the burner is firing using the thermal switch, wherein the thermal switch is configured to sense whether a temperature proximate to the main burner is equal to or greater than a predetermined threshold temperature;

controlling said flue damper based on the determination of whether said at least one main burner is firing.

12. A method of controlling a flue damper in a water heater according to claim 11, further comprising the step of electrically connecting the thermal switch to a thermostat.

13. A method of controlling a flue damper in a water heater according to claim 11, further comprising the step of controlling the flue damper to close when the burner is determined to be not firing.

14. A method of controlling a flue damper in a water heater according to claim 11, further comprising the step of controlling said flue damper to remain open when the burner is determined to be firing.

* * * * *